US008362954B2

(12) United States Patent
Nogami

(10) Patent No.: US 8,362,954 B2
(45) Date of Patent: Jan. 29, 2013

(54) ARRAY ANTENNA, TAG COMMUNICATION DEVICE, TAG COMMUNICATION SYSTEM, AND BEAM CONTROL METHOD FOR ARRAY ANTENNA

(75) Inventor: Hidekatsu Nogami, Kyoto (JP)

(73) Assignee: Omron Corporation, Kyoto (JP)

( * ) Notice: Subject to any disclaimer, the term of this patent is extended or adjusted under 35 U.S.C. 154(b) by 165 days.

(21) Appl. No.: 12/744,299

(22) PCT Filed: Feb. 24, 2009

(86) PCT No.: PCT/JP2009/053261

§ 371 (c)(1),
(2), (4) Date: Aug. 9, 2010

(87) PCT Pub. No.: WO2009/107601

PCT Pub. Date: Mar. 9, 2009

(65) Prior Publication Data

US 2010/0295729 A1 Nov. 25, 2010

(30) Foreign Application Priority Data

Feb. 29, 2008 (JP) ..... 2008-049959

(51) Int. Cl.
*H01Q 3/00* (2006.01)

(52) U.S. Cl. ..... 342/372; 342/373

(58) Field of Classification Search ..... 342/81, 342/372, 373; 343/700 MS, 777
See application file for complete search history.

(56) References Cited

U.S. PATENT DOCUMENTS

| | | | | |
|---|---|---|---|---|
| 5,359,337 | A * | 10/1994 | Eguchi | 343/765 |
| 6,184,828 | B1 | 2/2001 | Shoki | |
| 2008/0036662 | A1 | 2/2008 | Iwata et al. | |
| 2009/0284434 | A1 * | 11/2009 | Gothard et al. | 343/834 |
| 2011/0148707 | A1 * | 6/2011 | Thiesen et al. | 342/372 |
| 2012/0033761 | A1 * | 2/2012 | Guo et al. | 375/316 |

FOREIGN PATENT DOCUMENTS

| | | | |
|---|---|---|---|
| JP | 6-326510 | A | 11/1994 |
| JP | 2006-20083 | A | 1/2006 |
| JP | 2006-60771 | A | 3/2006 |
| JP | 2006-295966 | A | 10/2006 |
| JP | 2007-303935 | A | 11/2007 |
| JP | 2008-48077 | A | 2/2008 |
| WO | WO 2008/018254 | A1 | 2/2008 |

* cited by examiner

*Primary Examiner* — Dao Phan
(74) *Attorney, Agent, or Firm* — Dickstein Shapiro LLP

(57) ABSTRACT

Provided are an array antenna capable of miniaturizing an array antenna while reducing side lobes, a tag communication device and tag communication system provided with the array antenna, and a beam control method for the array antenna. When XY coordinates and a feeding phase of each antenna element (21*a* to 21*d*) are defined as the antenna element (21*a*) (0, Y1)·$\phi$1, the antenna element (21*b*) (−X1, 0)·$\phi$2, the antenna element (21*c*) (X2, 0)·$\phi$3, the antenna element (21*d*) (0, −Y2)·$\phi$4, wavelengths of $\lambda$, and directivity directions of $\theta$, each of the feeding phases is set so that the following conditional equations $\phi 1=\phi 4$, $\phi 2=2\pi\cdot X1\cdot\sin(\theta)/\lambda+\phi 1$, $\phi 3=\phi 1-2\pi\cdot X2\cdot\sin(\theta)/\lambda$ are all satisfied.

11 Claims, 7 Drawing Sheets

(a)

(b)

TB

| θ° | Φ 1 | Φ 2 | Φ 3 | Φ 4 |
|---|---|---|---|---|
| 10 | $V_{1A}$ | $V_{1B}$ | $V_{1C}$ | $V_{1D}$ |
| 20 | $V_{2A}$ | $V_{2B}$ | $V_{2C}$ | $V_{2D}$ |
| 30 | $V_{3A}$ | $V_{3B}$ | $V_{3C}$ | $V_{3D}$ |
| ⋮ | ⋮ | ⋮ | ⋮ | ⋮ |
| | | | | |

PRIOR ART

ARRAY ANTENNA, TAG COMMUNICATION DEVICE, TAG COMMUNICATION SYSTEM, AND BEAM CONTROL METHOD FOR ARRAY ANTENNA

TECHNICAL FIELD

The present invention relates to an array antenna in which a direction of a beam of a radio wave can be varied, a tag communication device and a tag communication system including the array antenna, and a beam control method for the array antenna.

BACKGROUND ART

An array antenna is conventionally known as one of directivity antennas. The array antenna has a plurality of arrayed antenna elements, and can electronically change a directivity direction of a beam of a radio wave while controlling a phase of a signal flowing to each antenna element. Since the directivity direction of the beam of the radio wave can be varied by changing a feeding phase of each antenna element, a communication region can be enlarged by scanning the beam of the radio wave as in a tag communication antenna described in Patent Document 1, or use can be made in detection of a tag movement direction as in a tag movement direction detection system described in Patent Document 2. A case in which an angle is denoted with degree (° or deg) as a unit, and a case in which the angle is denoted with a radian as a unit are provided in the present specification and the drawings, where in a portion where the angle is denoted with degree as a unit in a mathematical formula, the angle is handled with degree as a unit in such a mathematical formula. In a portion where the angle is denoted with radian as a unit in a mathematical formula, the angle is handled with radian as a unit in such a mathematical formula Miniaturization of the array antenna is desired, and reducing the number of configuring antenna elements is the most effective way to miniaturize the array antenna. The applicant uses an array antenna 200 including 3×2=six elements (210*a* to 210*f*) of three elements in a horizontal direction (X-axis) and two elements in a vertical direction (Y-axis), as shown in FIG. 7(*a*), as a prototype. The applicant uses the array antenna 200 as a prototype, and detects the movement direction of a package as described in Patent Document 2. In other words, as shown in FIG. 7(*b*), the movement direction of a movable body such as a package is detected by changing the feeding phase of each antenna element, and repeatedly changing the directivity direction of a main lobe (MLα, MLβ) or the beam of the radio wave emitted from the array antenna 200 in scan angles α, β (inclination angle in a horizontal direction with respect to a broadside direction). Such a method of detecting the movement direction is described in detail in Patent Document 2, but an outline will be described below with reference to FIG. 7(*c*).

If the directivity direction of the main lobe is a +direction in the figure with respect to the broadside direction (main lobe MLα), communication is not carried out with the RFID tag attached to the package on the scan angle β side (not shown) and communication is carried out only on the scan angle α side. Similarly, if the directivity direction of the main lobe is a —direction in the figure with respect to the broadside direction (main lobe MLαβ), communication is not carried out with the RFID tag attached to the package on the scan angle α side (not shown) and communication is carried out only on the scan angle β side. Since communication is carried out with the RFID tag by repeatedly switching the directivity direction of the main lobe to the scan angles α, β, a linear approximation line L is obtained from a distribution of a plurality of pieces of data (plot data P) communicated with the main lobe MLα and a plurality of pieces of data (plot data P) communicated with the main lobe MLβ, and a slope thereof is calculated to detect the movement direction. As is apparent with reference to FIG. 7(*c*), it is important that communication is not carried out with the RFID tag on the − side when switched to the main lobe MLα and that communication is not carried out on the + side when switched to the main lobe MLβ to enhance the accuracy of the movement direction detection.

Reducing the number of antenna elements is most effective for miniaturization, where the vertical direction and the horizontal direction desirably have the same directivity from the standpoints of inventory management such as VMI (Vendor Managed Inventory) and physical distribution management. The vertical and horizontal (vertical and horizontal directions) directivities are thus satisfactory, and the minimum array antenna becomes an array antenna 201 including 2×2=4 elements (211*a* to 211*d*) of two elements in the horizontal direction (X-axis) and two elements in the vertical direction (Y-axis), as shown in FIG. 8(*a*).

However, the applicant found through experiments that a new problem arises if the number of antenna elements is 2×2=4 elements. The new problem includes the problems of a side lobe and a grating lobe. In other words, as shown in FIG. 8(*b*), when switched to the main lobe MLα, a side lobe SLα becomes too large (similarly, when switched to the main lobe MLβ, a side lobe SLβ becomes too large), and the accuracy of the movement direction detection degrades. As shown in FIG. 8(*c*), if the side lobe becomes too large, the side lobe SLα generated on the − side at the same time as the generation of the main lobe MLα on the + side when switched to the scan angle α (similarly, the side lobe SLβ generated on the + side at the same time as the generation of the main lobe MLβ on the − side when switched to the scan angle β) communicates with the RFID tag (not shown). It is apparent through the experiments that the slope of the linear approximation line cannot be obtained, and the accuracy of the movement direction detection significantly degrades as a result.

A power distribution ratio to each antenna element is generally changed as shown in FIG. 9 to reduce such a side lobe. In other words, high power is supplied to the antenna element 212*c* at the middle and the power is lowered towards the ends in the plurality of antenna elements (212*a* to 212*e*). However, the control is complicating in such a method.

Patent Document 1: Japanese Unexamined Patent Publication No. 2006-20083

Patent Document 2: Japanese Unexamined Patent Publication No. 2007-303935

DISCLOSURE OF THE INVENTION

Problems to be Solved by the Invention

In view of solving the above problems, it is an object of the present invention to provide an array antenna in which the array antenna itself can be miniaturized while reducing a side lobe and a grating lobe, a tag communication device and a tag communication system including the array antenna, and a beam control method for the array antenna.

Means for Solving the Problems

In order to achieve the above object, the present invention provides an array antenna in which a directivity direction of a beam of a radio wave is electrically controllable; the array antenna including: a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line; a variable phase shifter for variably setting a feeding phase of each antenna element; and control means for controlling the variable phase shifter so that the directivity direction of the beam of the radio wave is changed along the first virtual line.

When the feeding phase of each antenna element is $\phi 2$ for the second antenna element, $\phi 3$ for the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0) for the second antenna element, (X2, 0) for the third antenna element, and (0, −Y2) for the fourth antenna element, a wavelength is $\lambda$, and the directivity direction is $\theta$, the control means may set each feeding phase so as to satisfy all of the following conditional equations: $\phi 1=\phi 4$, $\phi 2=2\pi\cdot X1\cdot\sin(\theta)/\lambda+\phi 1$, $\phi 3=\phi 1-2\pi\cdot X2\cdot\sin(\theta)/\lambda$ with respect to the variable phase shifter to direct the directivity direction of the beam of the radio wave in the $\theta$ direction from the Z-axis on an XZ plane.

Moreover, the present invention provides an array antenna in which a directivity direction of a beam of a radio wave is electrically controllable; the array antenna including: a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line; a variable phase shifter for variably setting a feeding phase of each antenna element; and control means for controlling the variable phase shifter so that the directivity direction of the beam of the radio wave is selectably changed along the first virtual line or the second virtual line.

When the feeding phase of each antenna element is $\phi 2$ for the second antenna element, $\phi 3$ for the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0)for the second antenna element, (X2, 0) for the third antenna element, and (0, −Y2) for the fourth antenna element, a wavelength is $\lambda$, and the directivity direction is $\theta$, the control means may set each feeding phase so as to satisfy all of the following conditional equations: $\phi 1=\phi 4$, $\phi 2=2\pi\cdot X1\cdot\sin(\theta)/\lambda+\phi 1$, $\phi 3=\phi 1-2\pi\cdot X2\cdot\sin(\theta)/\lambda$ with respect to the variable phase shifter to direct the directivity direction of the beam of the radio wave in the $\theta$ direction from the Z-axis on an XZ plane, and may set each feeding phase so as to satisfy all of the following conditional equations: $\phi 2=\phi 3$, $\phi 1=2\pi\cdot Y1\cdot\sin(\theta)/\lambda+\phi 2$, $\phi 4=\phi 2-2\pi\cdot Y2\cdot\sin(\theta)/\lambda$ to direct the directivity direction of the beam of the radio wave in the $\theta$ direction from the Z-axis on an YZ plane.

The numbers of the first antenna element, the second antenna element, the third antenna element, and the fourth antenna element are denoted to indicate that four antenna elements are arranged and to clarify the respective relationship, where the relationship of the respective arrangement relationship and the conditional equation is an important element in the present invention.

The first virtual line and the second virtual line are lines virtually used to clarify the arrangement relationship of the first to fourth antenna elements and are not solid lines. When referring to being arranged on the first virtual line or the second virtual line, this means that the center points of the first to fourth antenna elements are arranged on the respective virtual lines, but the center part is not required to be strictly positioned on the respective virtual lines and merely needs to be substantially positioned on the virtual line.

The first to fourth antenna elements may form a square shape, but may not form a square shape and may be a rhombic shape, and furthermore, each side (distance between the antenna elements) forming the square may not be the same.

The first antenna element, the second antenna element, the third antenna element, and the fourth antenna element may be patch antennas. The plurality of antenna elements are suitably configured from the patch antenna so that a scan antenna can be thinly manufactured and a manufacturing cost can be suppressed low.

A tag communication device according to the present invention is connected to the array antenna and wirelessly communicates with an RFID tag through the array antenna. The tag communication device refers to a reader, a writer, or a reader/writer.

A tag communication system according to the present invention is capable of repeatedly varying the directivity direction of the beam of the radio wave at a predetermined pitch by emitting a directivity angle command signal for determining the directivity direction of the beam of the radio wave to the array antenna from the tag communication device or a terminal device. The directivity angle command signal is a signal for determining the direction of the beam of the radio wave, and such a directivity angle command signal may be directly emitted from the tag communication device. The signal may be emitted from a terminal device such as a PC (personal computer) connected to the tag communication device through the tag communication device. Furthermore, the signal may be directly emitted from the terminal device without passing the tag communication device.

A beam control method for an array antenna according to the present invention is a method in which a directivity direction of a beam of a radio wave is electrically controllable, the array antenna including a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line, and a variable phase shifter for variably setting a feeding phase of each antenna element; and the method includes the step of controlling the variable phase shifter so that the directivity direction of the beam of the radio wave is changed along the first virtual line.

In the above-mentioned beam control method for an array antenna, when the feeding phase of each antenna element is $\phi 2$ for the second antenna element, $\phi 3$ for the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0) for the second antenna element, (X2, 0) for the third antenna element, and (0, −Y2) for the fourth antenna element, a wavelength is $\lambda$, and the directivity direction is $\theta$, each feeding phase may be set so as to satisfy all of the following conditional equations: $\phi 1=\phi 4$, $\phi 2=2\pi \cdot X1 \cdot \sin(\theta)/\lambda+\phi 1$, $\phi 3=\phi 1-2\pi \cdot X2 \cdot \sin(\theta)/\lambda$ with respect to the variable phase shifter to direct the directivity direction of the beam of the radio wave in the θ direction from the Z-axis on an XZ plane.

A beam control method for an array antenna is a method in which a directivity direction of a beam of a radio wave is electrically controllable; the array antenna including a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line, and a variable phase shifter for variably setting a feeding phase of each antenna element; and the method includes the step of controlling the variable phase shifter so that the directivity direction of the beam of the radio wave is selectably changed along the first virtual line or the second virtual line.

In the above-mentioned beam control method for an array antenna, when the feeding phase of each antenna element is $\phi 2$ for the second antenna element, $\phi 3$ for the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0) for the second antenna element, (X2, 0) for the third antenna element, and (0, −Y2) for the fourth antenna element, a wavelength is λ, and the directivity direction is θ, each feeding phase may be set so as to satisfy all of the following conditional equations: $\phi 1=\phi 4$, $\phi 2=2\pi \cdot X1 \cdot \sin(\theta)/\lambda+\phi 1$, $\phi 3=\phi 1-2\pi \cdot X2 \cdot \sin(\theta)/\lambda$ with respect to the variable phase shifter to direct the directivity direction of the beam of the radio wave in the θ direction from the Z-axis on an XZ plane, and each feeding phase may be set so as to satisfy all of the following conditional equations: $\phi 2=\phi 3$, $\phi 1=2\pi \cdot Y1 \cdot \sin(\theta)/\lambda+\phi 2$, $\phi 4=\phi 2-2\pi \cdot Y2 \cdot \sin(\theta)/\lambda$ to direct the directivity direction of the beam of the radio wave in the θ direction from the Z-axis on an YZ plane.

Effects of the Invention

According to the present invention described above, in an array antenna in which a directivity direction of a beam of a radio wave is electrically controllable, the array antenna including a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line, and a variable phase shifter for variably setting a feeding phase of each antenna element, the variable phase shifter is controlled so that the directivity direction of the beam of the radio wave is changed along the first virtual line. The entire antenna thus can be miniaturized while reducing the grating lobe and the side lobe.

BEST MODE FOR CARRYING OUT THE INVENTION

The best modes for carrying out the invention will be described in detail below with reference to the accompanied drawings.

Figure 1:
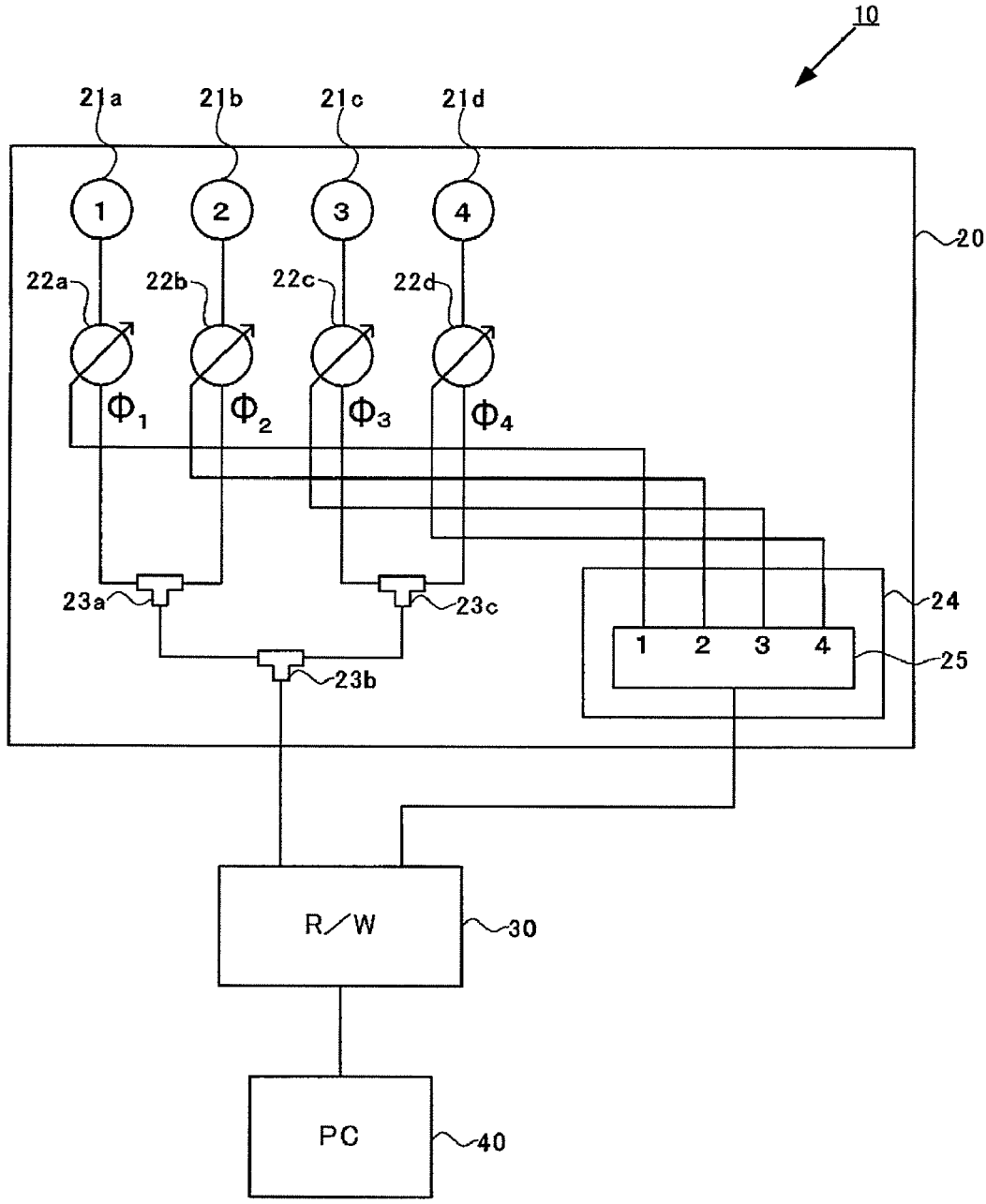
FIG. 1 is a block diagram schematically showing a schematic configuration of a tag communication system of the present invention.
Figure 2:
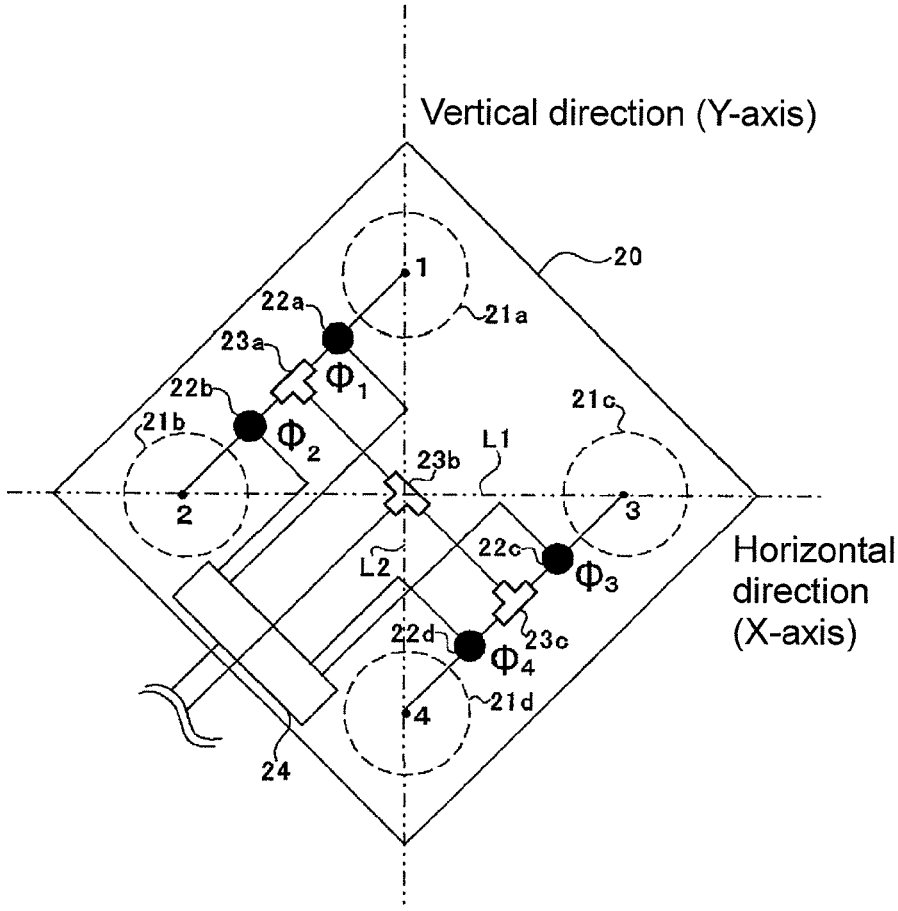
FIG. 2(*a*) is a plan view showing a schematic configuration of an array antenna of the present invention, and FIG. 2(*b*) is an internal table stored in a controller.
Figure 3:
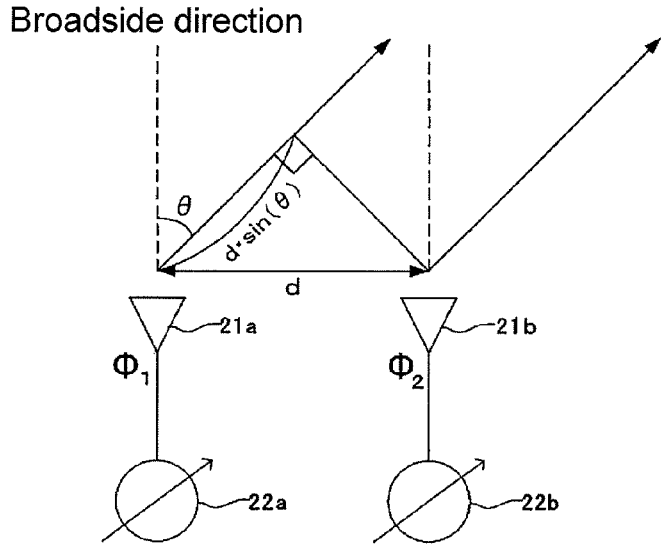
FIG. 3 is a schematic view describing a directivity direction of the array antenna of the present invention.
Figure 4:
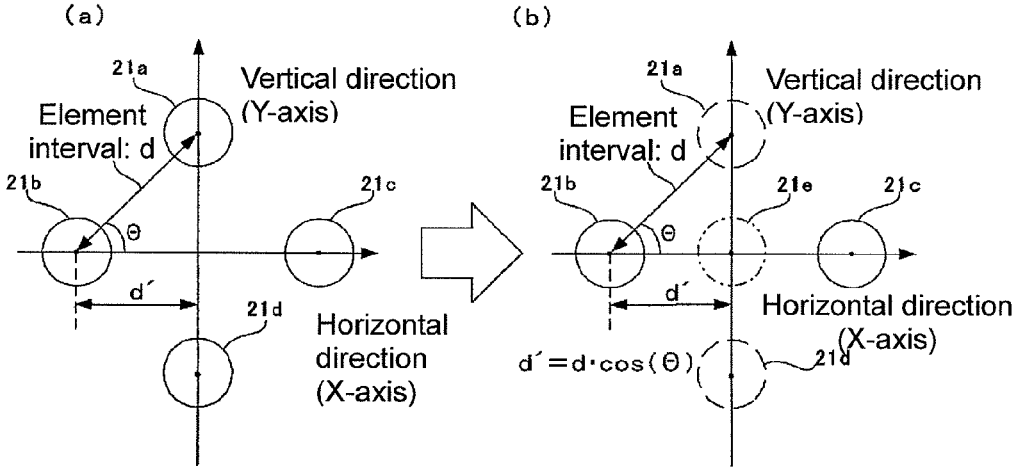
FIGS. 4(*a*) and 4(*b*) are conceptual views for describing a principle of a feeding phase to each antenna element of the array antenna of the present invention.
Figure 5:
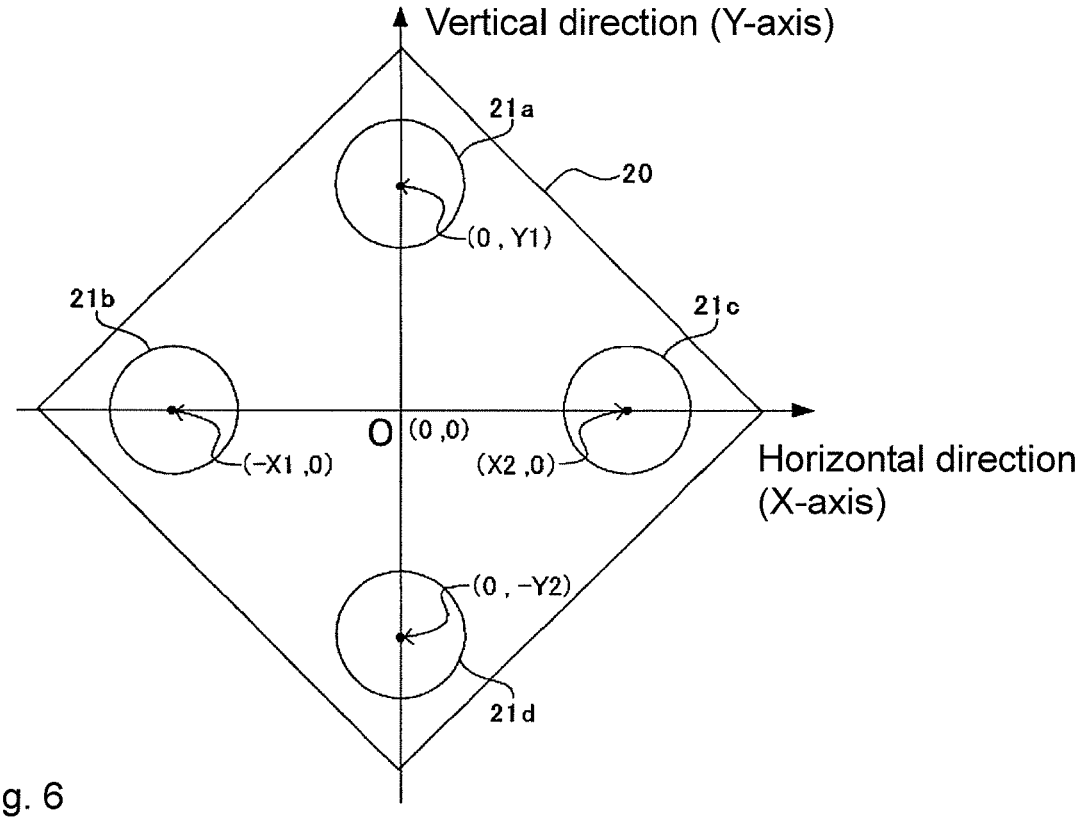
FIG. 5 is a conceptual view for describing the principle of the feeding phase to each antenna element of the array antenna of the present invention.
Figure 6:
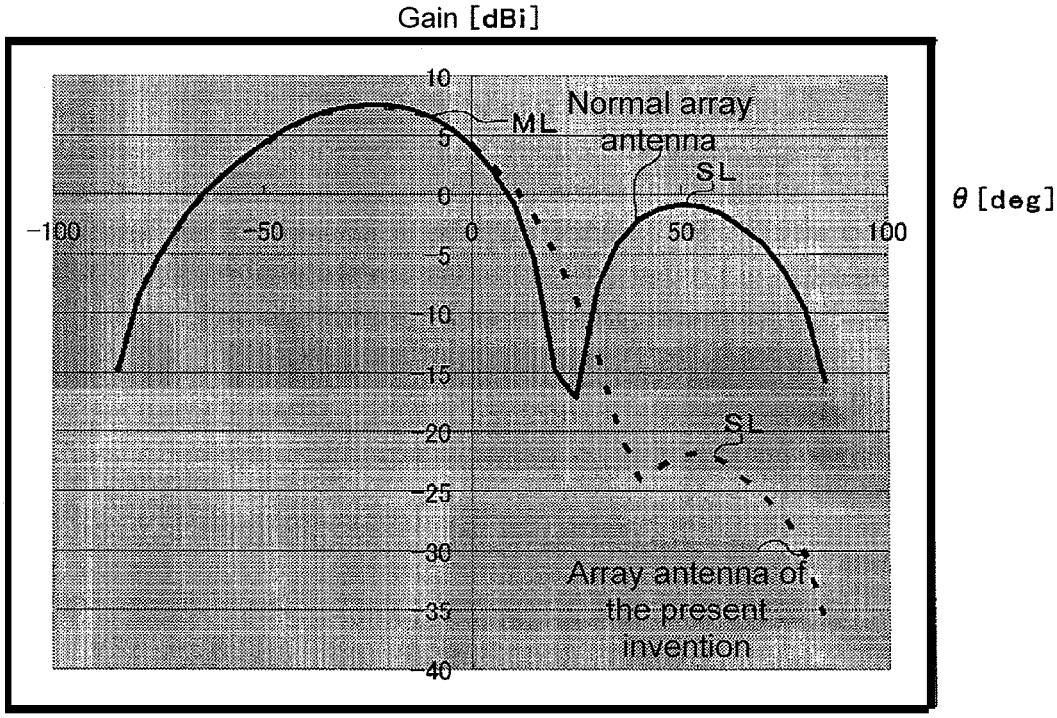
FIG. 6 shows a graph showing a reduction effect of a side lobe in the array antenna of the present invention.

FIG. 1 is a block diagram schematically showing a schematic configuration of a tag communication system of the present invention; FIG. 2(*a*) is a plan view of the schematic configuration of an array antenna of the present invention seen from a back surface side, and FIG. 2(*b*) is an internal table stored in a controller; FIG. 3 is a schematic view describing a directivity direction of the array antenna of the present invention; FIGS. 4(*a*) and 4(*b*) are conceptual views for describing a principle of a feeding phase to each antenna element of the array antenna of the present invention; FIG. 5 is a conceptual view for describing the principle of the feeding phase to each antenna element of the array antenna of the present invention; and FIG. 6 is a graph showing a reduction effect of a side lobe in the array antenna of the present invention.

As shown in FIG. 1, a tag communication system 10 of the present invention includes an array antenna 20, a reader/writer 30 connected to the array antenna 20, and a personal computer (hereinafter referred to as "PC") 40 connected to the reader/writer 30.

The array antenna 20 includes four antenna elements 21*a* to 21*d*, variable phase shifters 22*a* to 22*d* connected to the respective antenna elements 21*a* to 21*d*, and a control board 24 mounted with a controller 25 connected to each phase shifter 22*a* to 22*d*.

The four antenna elements 21*a* to 21*d* are circular patch antennas herein, that is, thin flat antennas in which a dielectric is stacked on a conductor plate made of copper and the like, which serves as a bottom board, and a circular conductor is further stacked thereon. The circular patch antenna is used as the antenna element herein, but the present invention is not limited thereto, and a square patch antenna, a dipole antenna, and the like are also applicable.

The antenna element 21*b* and the antenna element 21*c* are arranged on a virtual line L1, and the antenna element 21*a* and the antenna element 21*d* are arranged on a virtual line L2. The virtual line L1 and the virtual line L2 are virtual lines used to describe that each antenna element 21*a* to 21*d* is arranged on the respective axis line when a horizontal direction is an X-axis and a vertical direction is a Y-axis as shown in FIG. 2(*a*), and are not solid lines.

When referring to "the antenna element 21*b* and the antenna element 21*c* are arranged on the virtual line L1 (the antenna element 21*a* and the antenna element 21*d* are arranged on the virtual line L2)", this means that the center of each antenna element 21*a* to 21*d* is positioned on the respective virtual line L1, L2, but the center part is not required to be strictly positioned on the respective virtual line L1, L2 and merely needs to be substantially positioned on the virtual line L1, L2. The horizontal direction (X-axis) and the vertical direction (Y-axis) as referred to herein are a direction and an axis of when scanning a main beam, to be described later.

Each antenna element 21*a* to 21*d* configure a square shape herein, but may not configure a square shape, and may configure a rhombic shape, and furthermore, each side (distance d between antenna elements) forming the square may not be the same.

The four variable phase shifters 22*a* to 22*d* are elements functioning to change the feeding phase to each antenna element, and various variable phase shifters are applicable. For example, the variable phase shifter may be a variable phase shifter configured by inserting liquid crystal between a conductor path and a ground. When a control signal is applied between the conductor path and the ground, the dielectric constant of the liquid crystal changes and thereby changing a propagation speed of a microwave transmitted through the transmission path as a result.

The controller 25 functions to control a DC voltage to each variable phase shifter 22*a* to 22*d* in response to an angle command signal transmitted from the reader/writer 30, and internally stores an internal table TB shown in FIG. 2(*b*). The angle command signal is a signal instructing an angle θ that defines a directivity direction of a beam (main lobe) of a radio wave emitted from the array antenna 20. The internal table TB stores the feeding phase ϕ1 to ϕ4 to each antenna element 21*a* to 21*d* in association with the DC voltage for every directivity direction θ. For example, if the angle command signal instructing the directivity direction θ=10° is transmitted from the reader/writer 30, the DC voltage of $V_{1A}$, $V_{1B}$, $V_{1C}$, $V_{1D}$ [V] is applied to each antenna element 21*a* to 21*d* so that the directivity direction of the beam of the radio wave becomes θ=10°.

The reader/writer 30 functions to transmit the angle command signal to the controller 25 and transmit an RF (Radio Frequency) signal to each antenna element 21*a* to 21*d* under the control of the PC 40. The RF signal is first divided into two for the antenna elements 21*a* and 21*b* side and the antenna elements 21*c* and the antenna element 21*d* side by a distributor 23*b*, and the distributed RF signal is further distributed to the antenna elements 21*a* and 21*b* by a distributor 23*a* and to the antenna elements 21*c* and 21*d* by a distributor 23*c*.

Herein, the angle command signal is transmitted or the RF signal is transmitted under the control of the PC 40, but a configuration in which the control function of the PC 40 is incorporated in the reader/writer 30 and the PC 40 is unnecessary may also be applicable. The controller 25 is configured to be mounted on the array antenna 20, but a configuration in which the function of the controller 25 is externally provided so that the controller 25 is not mounted on the array antenna 20, or a configuration in which the relevant function is incorporated in the reader/writer 30 may also be applicable. In the present invention, the array configuration of each antenna element 21*a* to 21*d*, and the feeding phase to each antenna element 21*a* to 21*d* are set to satisfy the following mathematical formula, where various configurations can be applied to other configurations.

In the present invention, when each antenna element 21*a* to 21*d* of the array antenna 20 is arranged, that is, when a horizontal direction is n X-axis, a vertical direction is a Y-axis, and an axis orthogonal to an XY plane is a Z-axis, coordinates of each antenna are antenna element 21*a* (0, Y1), antenna element 21*b* (−X1, 0), antenna element 21*c* (X2, 0), and antenna element 21*d* (0, −Y2), a wavelength is λ and a directivity direction is θ, and each feeding phase is set to satisfy all of the following conditional equations:

$$\phi 1=\phi 4$$

$$\phi 2=2\pi\cdot X1\cdot\sin(\theta)/\lambda+\phi 1$$

$$\phi 3=\phi 1-2\pi\cdot X2\cdot\sin(\theta)/\lambda \qquad \text{<Equation 1>}$$

so that the directivity direction of the beam of the radio wave can be directed in the θ direction from the Z-axis on the XZ plane. This principle will be described below with reference to FIGS. 3 to 5.

FIG. 3 is a schematic view for describing the principle of control of the directivity direction in the array antenna. Specifically, when the antenna element 21*a* and the antenna element 21*b* are arranged in parallel spaced apart by a distance d, the directivity direction of the beam of the radio wave is inclined in the θ direction with respect to a broadside direction with the respective feeding phase as ϕ1, ϕ2. The feeding phase ϕ1, ϕ2 to each antenna element 21*a*, 21*b* is determined by the desired directivity direction (directivity angle θ) and the distance d of the antenna element 21*a*, 21*b*, where the wave front of the θ direction is matched assuming the desired directivity angle is θ. Therefore, <Equation 2>

$$d\cdot\sin(\theta)=(\phi 1-\phi 2)\cdot\lambda/2\pi \qquad (1)$$

is obtained.

Regarding the array antenna 20 including four antenna elements 21*a* to 21*d* of the present invention and having each antenna element 21*a* to 21*d* arranged in a square shape, assuming the angle between the line indicating the distance d and the X-axis as Θ as in the figure and an origin as O (0, 0), a distance d' between the origin O and the antenna element 21*b* is obtained by <Equation 3>

$$d'=d\cdot\cos(\Theta) \qquad (2)$$

Looking at the array antenna 20 in the horizontal direction, the antenna element 21*e* appears as if existing at the origin O (0, 0), which is equivalent to when three antenna elements 21*b*, 21*e*, 21*c* are arranged on the X-axis with the distance d' when seen in the horizontal direction. Since the arrangement is a square shape, Θ=45°, and $$d'=d/\sqrt{2}$$

is obtained.

Figure 7:
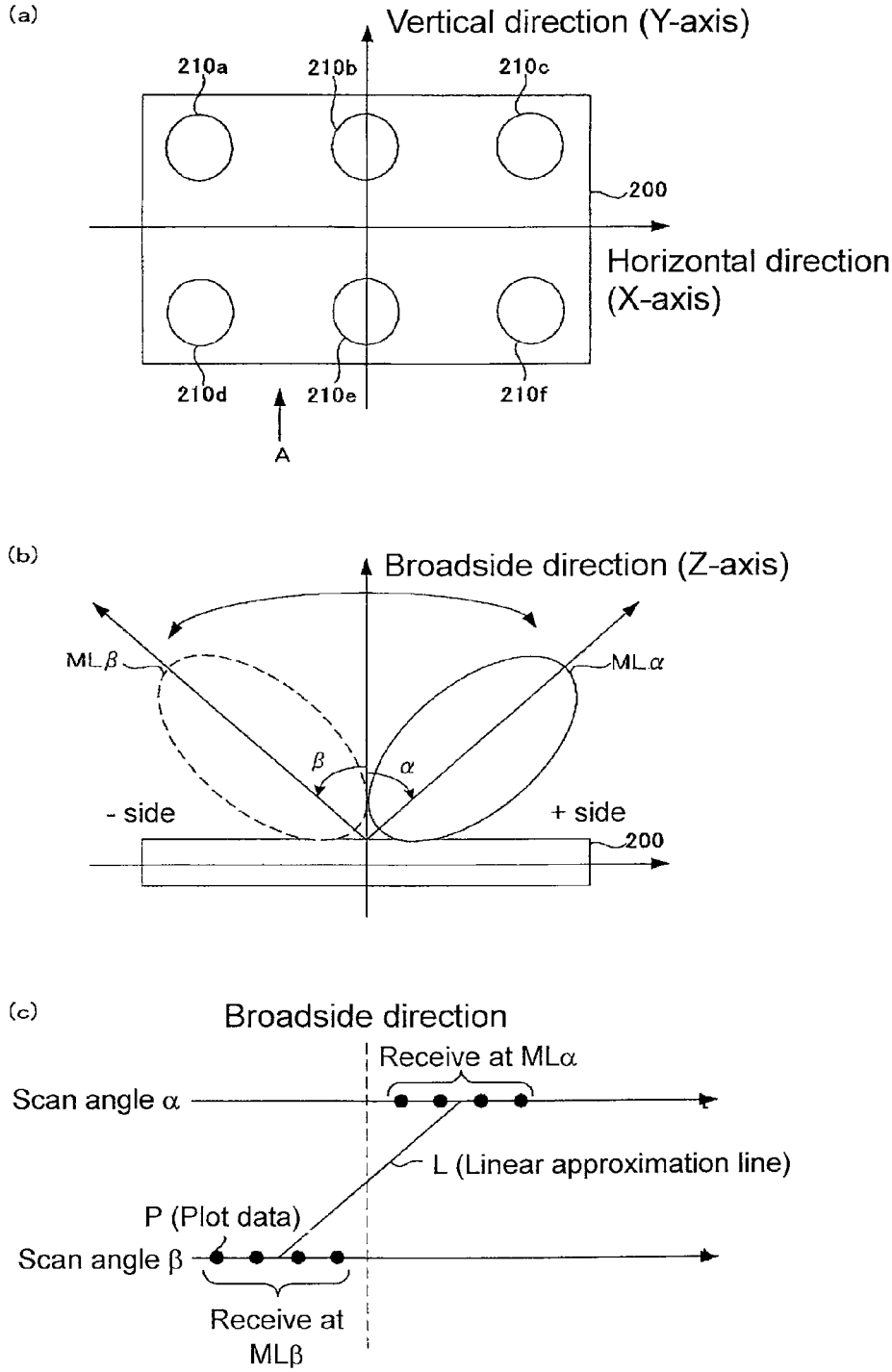
Fig. 7 PRIOR ART
FIG. 7(*a*) is a plan view showing a schematic configuration of a conventional array antenna, FIG. 7(*b*) is a schematic view showing a scanning state, and FIG. 7(*c*) is a graph showing a principle of movement direction detection.

The XY coordinates of each antenna element 21*a* to 21*d* when each antenna element 21*a* to 21*d* is numbered 1 to 4 as in FIG. 5, the feeding phase to each antenna element 21*a* to 21*d* is assumed as ϕ1 to ϕ4, and the X-axis and the Y-axis are taken as in the figure are antenna element 21*a* (0, Y1), 21*b* (−X2, 0), 21*c* (X2, 0), 21*d* (0, −Y2). In the present invention, when directing the direction of the main lobe with the X-axis as the axis of the directivity direction as in FIG. 7(*b*), that is, when directing the main beam in the θ direction from the Z-axis on the XZ plane with the broadside direction as the Z-axis, the feeding phases $\phi 1$ and $\phi 4$ need to satisfy $\phi 1=\phi 4$ . . . (3), where each feeding phase $\phi 1$ to $\phi 4$ need to satisfy all of the following conditional equations (3) to (5) from equation (3) and equation (1).

$$\phi 1=\phi 4 \quad (3)$$

$$\phi 2=2\pi \cdot X1 \cdot \sin(\theta)/\lambda+\phi 1 \quad (4)$$

$$\phi 3=\phi 1-2\pi \cdot X2 \cdot \sin(\theta)/\lambda \quad (5)$$

Figure 8:
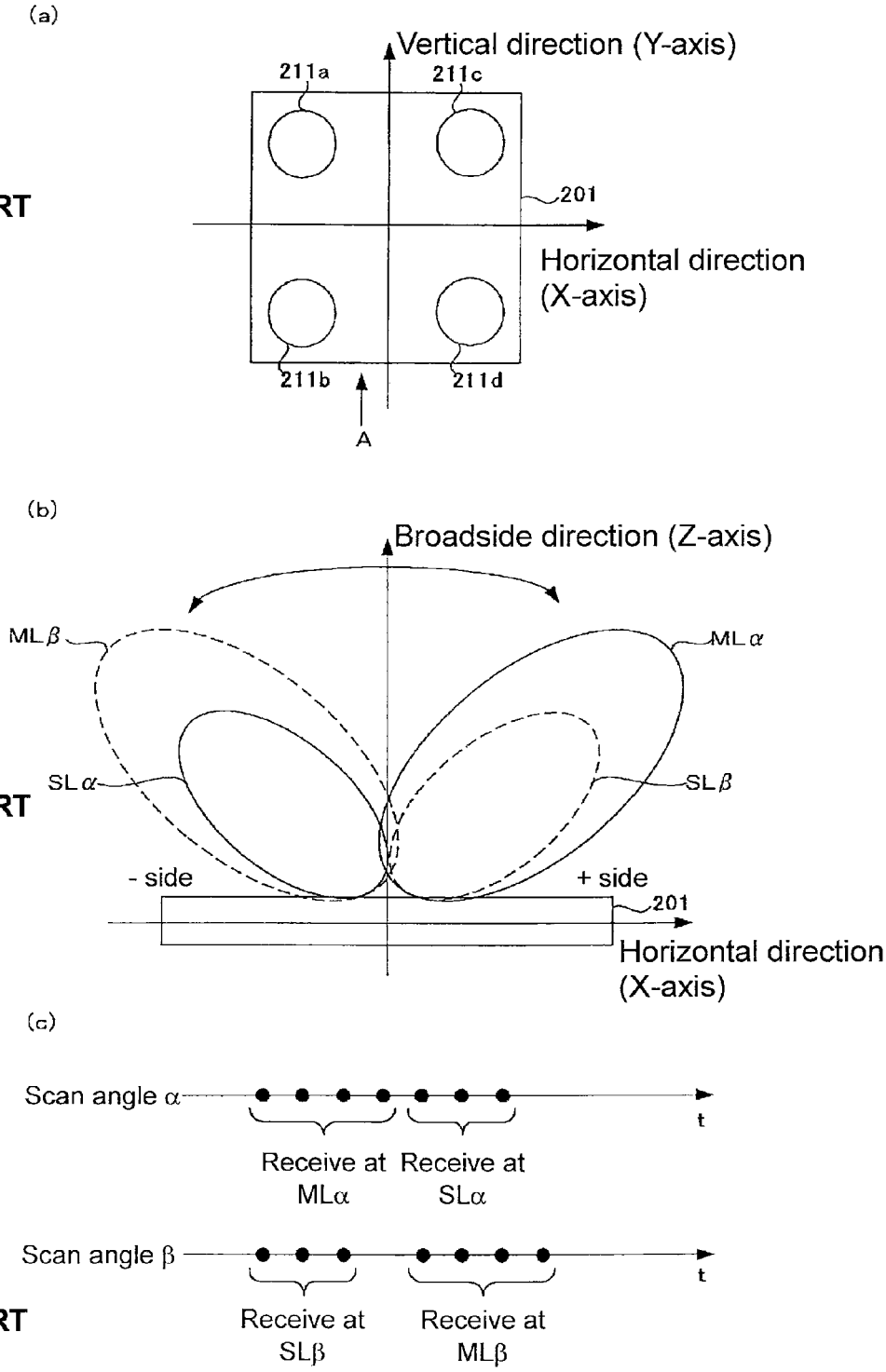
Fig. 8 PRIOR ART
FIG. 8(*a*) is a plan view showing a schematic configuration of a conventional array antenna, FIG. 8(*b*) is a schematic view showing a scanning state, and FIG. 8(*c*) is a graph showing a principle of movement direction detection.
Figure 9:
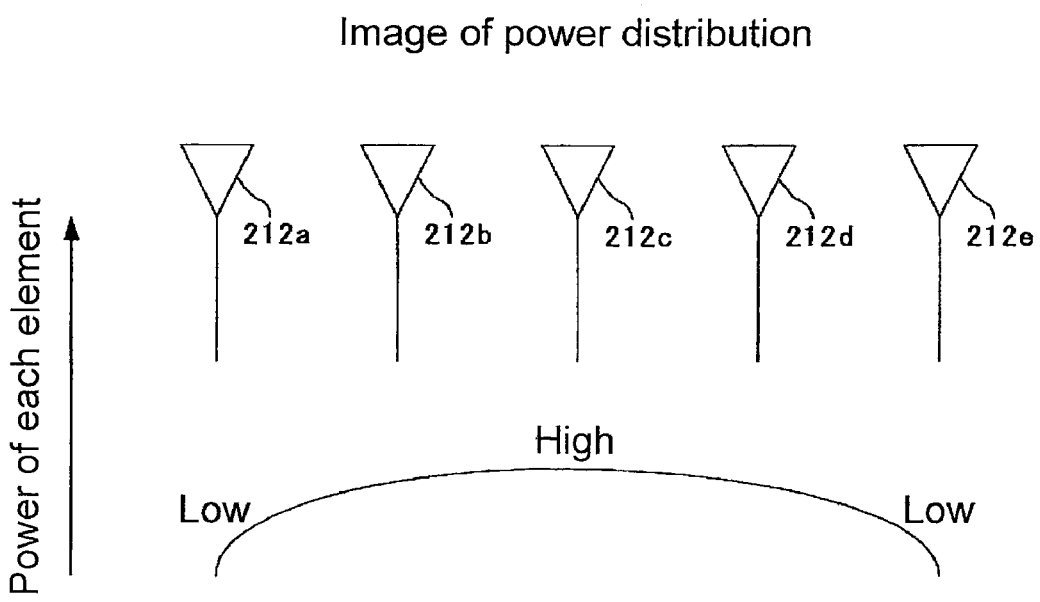
FIG. 9 is a conceptual view showing one example of a method of reducing a side lobe of the related art.

The phase difference in the array antenna 20 of the present invention configured as above and the phase difference in the array antenna 201 (hereinafter referred to as "conventional array antenna") configured as FIG. 8(*a*) are compared using specific numerical values. When the distance d of the antenna elements shown in FIG. 4(*a*) is 150 mm (0.15 m), the array antenna 20 having a square shape in which one side is 150 mm in the entire antenna elements 21*a* to 21*d* is formed, and the usage frequency is 950 MHz (wavelength $\lambda$=0.31 m), $\phi 1-\phi 2$=99° is obtained from equation (1) to realize the directivity direction of −35°. In the array antenna 20 of the present invention, $\phi 2-\phi 1$=70°, $\phi 1-\phi 3$=70° are obtained.

The effects shown in FIG. 6 are obtained by configuring the array antenna 20 of the present invention as described above. FIG. 6 shows a generation state of the side lobe when the directivity direction is set to −35° in comparison with a normal array antenna. Taking a gain [dBi] on the vertical axis and $\theta$ [deg] on the horizontal axis, the solid line shows a case where the array antenna shown in FIG. 8(*a*) is used and the dotted line shows a case where the array antenna of the present invention is used, where a first hill on the left side of the figure shows the gain of the main lobe and a second hill on the right side shows the gain of the side lobe in the respective array antenna. As is apparent from FIG. 6, the side lobe is dramatically reduced compared to the normal array antenna of the related art. Therefore, in the present invention, each antenna element 21*a* to 21*d* is arranged as in FIG. 2(*a*) and FIG. 5, and the feeding phase $\phi 1$ to $\phi 4$ to each antenna element 21*a* to 21*d* is set so as to satisfy all of the above conditional equations (3) to (5), so that the array antenna itself can be miniaturized while reducing the side lobe. Accuracy in detection of a movable body does not degrade while realizing the miniaturization of the array antenna itself by using the miniaturized array antenna in the detection of the movement direction of the movable body such as a package described above.

A case in which the horizontal direction is the axis has been described above, but the vertical direction (Y-axis) may be set as the axis, in which case, the directivity direction of the beam of the radio wave can be directed in the $\theta$ direction from the Z-axis on the YZ plane by setting each feeding phase $\phi 1$ to $\phi 4$ so as to satisfy all of the following conditional equations, similar to the above.

<Equation 5>

$$\phi 2=\phi 3$$

$$\phi 1=2\pi \cdot Y1 \cdot \sin(\theta)/\lambda+\phi 2$$

$$\phi 4=\phi 2-2\pi \cdot Y2 \cdot \sin(\theta)/\lambda$$

The directivity direction of the beam of the radio wave may be made selectable along the horizontal direction or the vertical direction by the controller 25.

The invention claimed is:

1. An array antenna in which a directivity direction of a beam of a radio wave is electrically controllable; the array antenna comprising:

a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line;

a variable phase shifter for variably setting a feeding phase of each antenna element; and control means for controlling the variable phase shifter so that the directivity direction of the beam of the radio wave is changed along the first virtual line.

2. The array antenna according to claim 1, wherein when the feeding phase of each antenna element is $\phi 2$ for the second antenna element, $\phi 3$ or the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0)for the second antenna element, (X2, 0) for the third antenna element, and (0, −Y2) for the fourth antenna element, a wavelength is $\lambda$, and the directivity direction is $\theta$, the control means sets each feeding phase so as to satisfy all of the following conditional equations $$\phi 1=\phi 4$$

$$\phi 2=2\pi \cdot X1 \cdot \sin(\theta)/\lambda+\phi 1$$

$$\phi 3=\phi 1-2\pi \cdot X2 \cdot \sin(\theta)/\lambda$$

with respect to the variable phase shifter to direct the directivity direction of the beam of the radio wave in the $\theta$ direction from the Z-axis on an XZ plane.

3. An array antenna in which a directivity direction of a beam of a radio wave is electrically controllable; the array antenna comprising:

a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line;

a variable phase shifter for variably setting a feeding phase of each antenna element; and control means for controlling the variable phase shifter so that the directivity direction of the beam of the radio wave is selectably changed along the first virtual line or the second virtual line.

4. The array antenna according to claim 3, wherein when the feeding phase of each antenna element is $\phi 2$ for the second antenna element, $\phi 3$ for the third antenna element, $\phi 1$ for the first antenna element, and $\phi 4$ for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0)for the second antenna element, (X2, 0) for the third antenna element, and ( 0, −Y2) for the fourth antenna element, a wavelength is λ, and the directivity direction is θ, the control means sets each feeding phase so as to satisfy all of the following conditional equations $$\phi 1=\phi 4$$

$$\phi 2=2\pi\cdot X1\cdot\sin(\theta)/\lambda+\phi 1$$

$$\phi 3=\phi 1-2\pi\cdot X2\cdot\sin(\theta)/\lambda$$

with respect to the variable phase shifter to direct the directivity direction of the beam of the radio wave in the θ direction from the Z-axis on an XZ plane, and sets each feeding phase so as to satisfy all of the following conditional equations $$\phi 2=\phi 3$$

$$\phi 1=2\pi\cdot Y1\cdot\sin(\theta)/\lambda+\phi 2$$

$$\phi 4=\phi 2-2\pi\cdot Y2\cdot\sin(\theta)/\lambda$$

to direct the directivity direction of the beam of the radio wave in the θ direction from the Z-axis on an YZ plane.

5. The array antenna according to claim 1, wherein the first antenna element, the second antenna element, the third antenna element, and the fourth antenna element are patch antennas.

6. A tag communication device, connected to the array antenna according to claim 1, for wirelessly communicating with an RFID tag through the array antenna.

7. A tag communication system in which the directivity direction of the beam of the radio wave is repeatedly varied at a predetermined pitch by emitting a directivity angle command signal for determining the directivity direction of the beam of the radio wave to the array antenna from the tag communication device according to claim 6.

8. A beam control method for an array antenna in which a directivity direction of a beam of a radio wave is electrically controllable, the array antenna including a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line, and a variable phase shifter for variably setting a feeding phase of each antenna element; the method comprising the step of:

controlling the variable phase shifter so that the directivity direction of the beam of the radio wave is changed along the first virtual line.

9. The beam control method for an array antenna according to claim 8, wherein when the feeding phase of each antenna element is ϕ2 for the second antenna element, ϕ3 for the third antenna element, ϕ1 for the first antenna element, and ϕ4 for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0)for the second antenna element, (X2, 0) for the third antenna element, and (0, −Y2) for the fourth antenna element, a wavelength is λ, and the directivity direction is θ, each feeding phase is set so as to satisfy all of the following conditional equations $$\phi 1=\phi 4$$

$$\phi 2=2\pi\cdot X1\cdot\sin(\theta)/\lambda+\phi 1$$

$$\phi 3=\phi 1-2\pi\cdot X2\cdot\sin(\theta)/\lambda$$

with respect to the variable phase shifter to direct the directivity direction of the beam of the radio wave in the θ direction from the Z-axis on an XZ plane.

10. A beam control method for an array antenna in which a directivity direction of a beam of a radio wave is electrically controllable; the array antenna including a second antenna element and a third antenna element, which are arranged spaced apart on a first virtual line, and a first antenna element and a fourth antenna element, which are arranged spaced apart on a second virtual line orthogonal to the first virtual line so as to sandwich the first virtual line, and a variable phase shifter for variably setting a feeding phase of each antenna element; the method comprising the step of:

controlling the variable phase shifter so that the directivity direction of the beam of the radio wave is selectably changed along the first virtual line or the second virtual line.

11. The beam control method for an array antenna according to claim 10, wherein when the feeding phase of each antenna element is ϕ2 for the second antenna element, ϕ3 for the third antenna element, ϕ1 for the first antenna element, and ϕ4 for the fourth antenna element, XY coordinates of each antenna element when the first virtual line is an X-axis, the second virtual line is a Y-axis, an intersection of the X-axis and the Y-axis is an origin (0, 0) and an axis passing the origin and being orthogonal to an XY plane is a Z-axis are (0, Y1) for the first antenna element, (−X1, 0)for the second antenna element, (X2, 0) for the third antenna element, and (0, −Y2) for the fourth antenna element, a wavelength is λ, and the directivity direction is θ, each feeding phase is set so as to satisfy all of the following conditional equations $$\phi 1=\phi 4$$

$$\phi 2=2\pi\cdot X1\cdot\sin(\theta)/\lambda+\phi 1$$

$$\phi 3=\phi 1-2\pi\cdot X2\cdot\sin(\theta)/\lambda$$

with respect to the variable phase shifter to direct the directivity direction of the beam of the radio wave in the θ direction from the Z-axis on an XZ plane, and each feeding phase is set so as to satisfy all of the following conditional equations $$\phi 2=\phi 3$$

$$\phi 1=2\pi\cdot Y1\cdot\sin(\theta)/\lambda+\phi 2$$

$$\phi 4=\phi 2-2\pi\cdot Y2\cdot\sin(\theta)/\lambda$$

to direct the directivity direction of the beam of the radio wave in the θ direction from the Z-axis on an YZ plane.

* * * * *

UNITED STATES PATENT AND TRADEMARK OFFICE

CERTIFICATE OF CORRECTION

PATENT NO. : 8,362,954 B2
APPLICATION NO. : 12/744299
DATED : January 29, 2013
INVENTOR(S) : Hidekatsu Nogami It is certified that error appears in the above-identified patent and that said Letters Patent is hereby corrected as shown below:

Title Page item (87), the PCT Pub. Date should read:

(87) PCT Pub. Date: September 3, 2009

Signed and Sealed this
Sixteenth Day of July, 2013

Teresa Stanek Rea
*Acting Director of the United States Patent and Trademark Office*